United States Patent [19]

Eberle

[11] Patent Number: 4,862,997

[45] Date of Patent: Sep. 5, 1989

[54] WHEEL CHAIR WITH ELEVATING SEAT HAVING A HIGH LIFT CAPABILITY

[76] Inventor: Kenneth F. Eberle, 3790 Twilight Dr., Rapid City, S. Dak. 57701

[21] Appl. No.: 96,636

[22] Filed: Sep. 14, 1987

[51] Int. Cl.[4] ..... B66B 9/20

[52] U.S. Cl. ..... 187/11; 187/14; 414/921; 297/345

[58] Field of Search ..... 414/921; 187/9 R, 76, 187/82, 83, 84, 92, 93, 11, 27, 136, 140, 35, 12–14; 280/289 WC, 242 WC; 297/0.4, 345; 5/81 R, 83, 88; 182/14, 141

[56] References Cited

U.S. PATENT DOCUMENTS

| | | | |
|---|---|---|---|
| 1,021,114 | 3/1912 | Slowe | 187/93 |
| 1,113,667 | 10/1914 | Mahaj | 187/84 X |
| 1,924,751 | 8/1933 | Porter | 187/11 X |
| 1,993,309 | 3/1935 | Rubin | 187/35 X |
| 2,035,294 | 3/1936 | Black | 182/14 |
| 2,516,726 | 7/1950 | Saxton et al. | 187/12 |
| 2,619,195 | 11/1952 | Scott | 187/12 |
| 2,634,405 | 4/1953 | Van Stone et al. | 187/136 X |
| 2,894,605 | 7/1959 | Leavitt | 187/11 |
| 3,076,678 | 2/1963 | Griffin | 297/339 |
| 3,385,401 | 5/1968 | Campbell et al. | 187/11 |
| 3,802,524 | 4/1974 | Seidel | 297/D4 X |
| 4,399,570 | 8/1983 | Tracy et al. | 297/345 X |
| 4,477,117 | 10/1984 | Higgs | 297/45 |
| 4,592,562 | 6/1986 | Strautnieks et al. | 414/921 X |
| 4,613,151 | 9/1986 | Kielczewski | 280/650 |
| 4,614,246 | 9/1986 | Masse et al. | 180/6.5 |
| 4,669,943 | 6/1987 | Zamotin | 414/921 X |
| 4,704,749 | 11/1987 | Aubert | 5/83 X |

FOREIGN PATENT DOCUMENTS

| | | | |
|---|---|---|---|
| 1313 | 4/1982 | PCT Int'l Appl. | 414/921 |
| 10481 | of 1901 | United Kingdom | 187/92 |
| 2017014 | 10/1979 | United Kingdom | 414/921 |

*Primary Examiner*—Joseph J. Rolla
*Assistant Examiner*—Kenneth Noland
*Attorney, Agent, or Firm*—Donald A. Kettlestrings

[57] ABSTRACT

A wheel chair with elevating seat having a high lift capability includes a frame assembly having a plurality of wheels attached to and normally supporting the frame assembly. A pair of opposed, vertical track members are atached to and project upwardly from the frame assembly, and elements are provided for selectively moving a chair substantially along the lengths of the track members. The lengths of the track members provide high lift capabilities for the chair while permitting passage through standard residential door openings whereby the operator is enabled to perform household and other tasks which otherwise would not be possible.

18 Claims, 8 Drawing Sheets

Fig. 10.
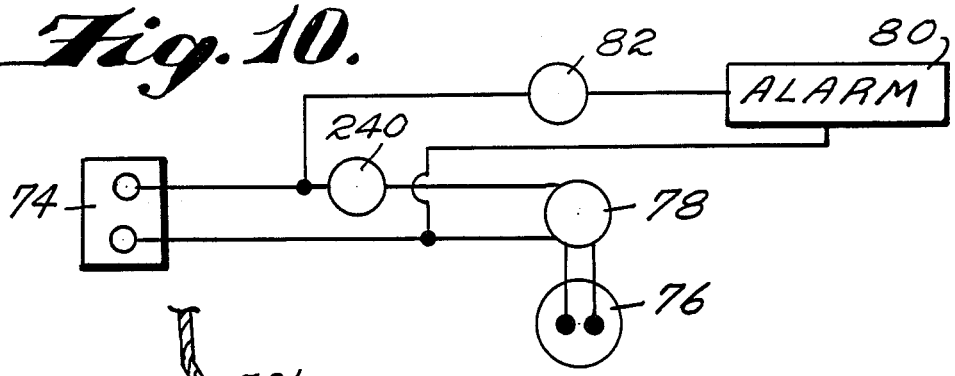
Fig. 7.
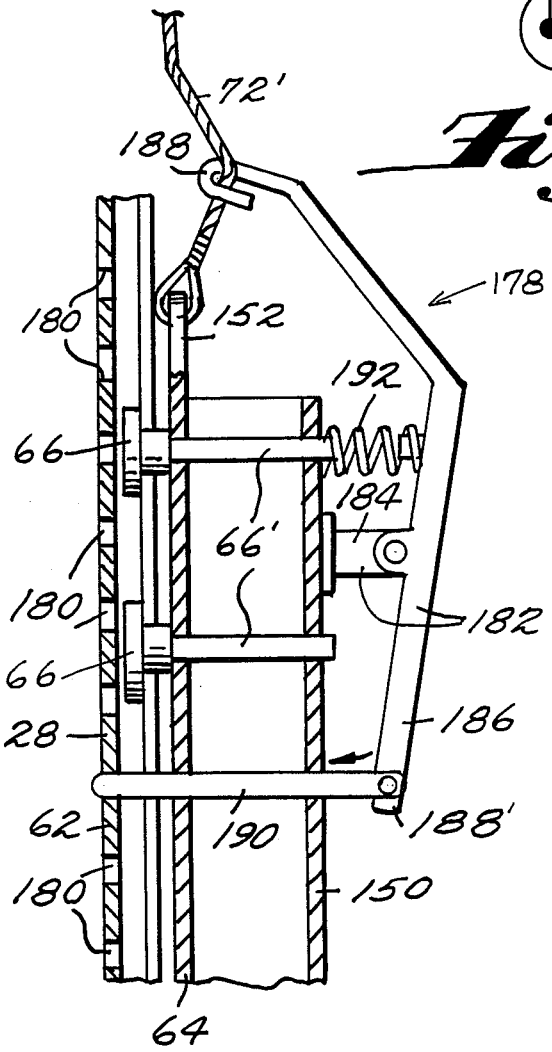
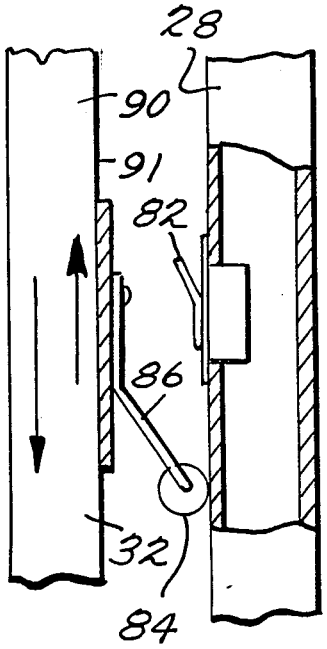
Fig. 8.

WHEEL CHAIR WITH ELEVATING SEAT HAVING A HIGH LIFT CAPABILITY

This invention relates to wheel chairs and more particularly to a wheel chair with an elevating seat having high lift capabilities.

Many types of wheel chairs with elevating seats are known. Although such wheel chairs have served the purpose, they have not proved entirely satisfactory for the reason that they provide only relatively low lift capability for the seat and are not suitable for high lift applications.

It is, therefore, an object of the present invention to provide a wheel chair having an elevating seat of high lift capability.

Another object is to provide such a wheel chair which provides the user with access to all household wall and ceiling surfaces, enabling him to accomplish ordinary tasks such as replacing light bulbs, cleaning walls, ceilings and windows, hanging draperies, and the like.

A further object of the invention is the provision of such a wheel chair which enables the user to perform outdoor tasks, such as maintenance and repairs on low profile buildings, picking fruit, trimming tall hedges, and the like.

Still another object is to provide such a wheel chair having an elevating seat of high lift capability which enables the user to perform household tasks, such as installing wall and ceiling systems, installing electrical wiring and fixtures, installing moulding, trim and mill work items, hanging doors and the like.

Yet another object of the present invention is the provision of such a wheel chair which enables the user to safely operate power tools and equipment, such as table saws, lathes and the like.

A still-further object is to provide such a wheel chair having an elevating seat of high lift capability which enables the user to paint vehicles, perform welding and grinding operations at heights otherwise unreachable by a person in a wheel chair.

Another object is to provide such a wheel chair which will increase the personal independence and employability of its user.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a wheel chair, comprising: a frame assembly; a plurality of wheels attached to and normally supporting the frame assembly; a pair of opposed, substantially vertical track members attached to and projecting upwardly from the frame assembly; a chair; and means in operative relationship with the chair and with the track members for selectively moving the chair substantially along the lengths of the track members.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

FIG. 7 is a fragmentary view, partly in section, showing means for preventing the chair from falling in an uncontrolled manner;

FIG. 8 is a fragmentary illustration partly in section, illustrating the alarm mechanism for alerting the operator when the chair is approaching its upper limit of travel;

FIG. 10 is a schematic illustration of the electrical circuitry used to operate the wheel chair;

Figure 1:
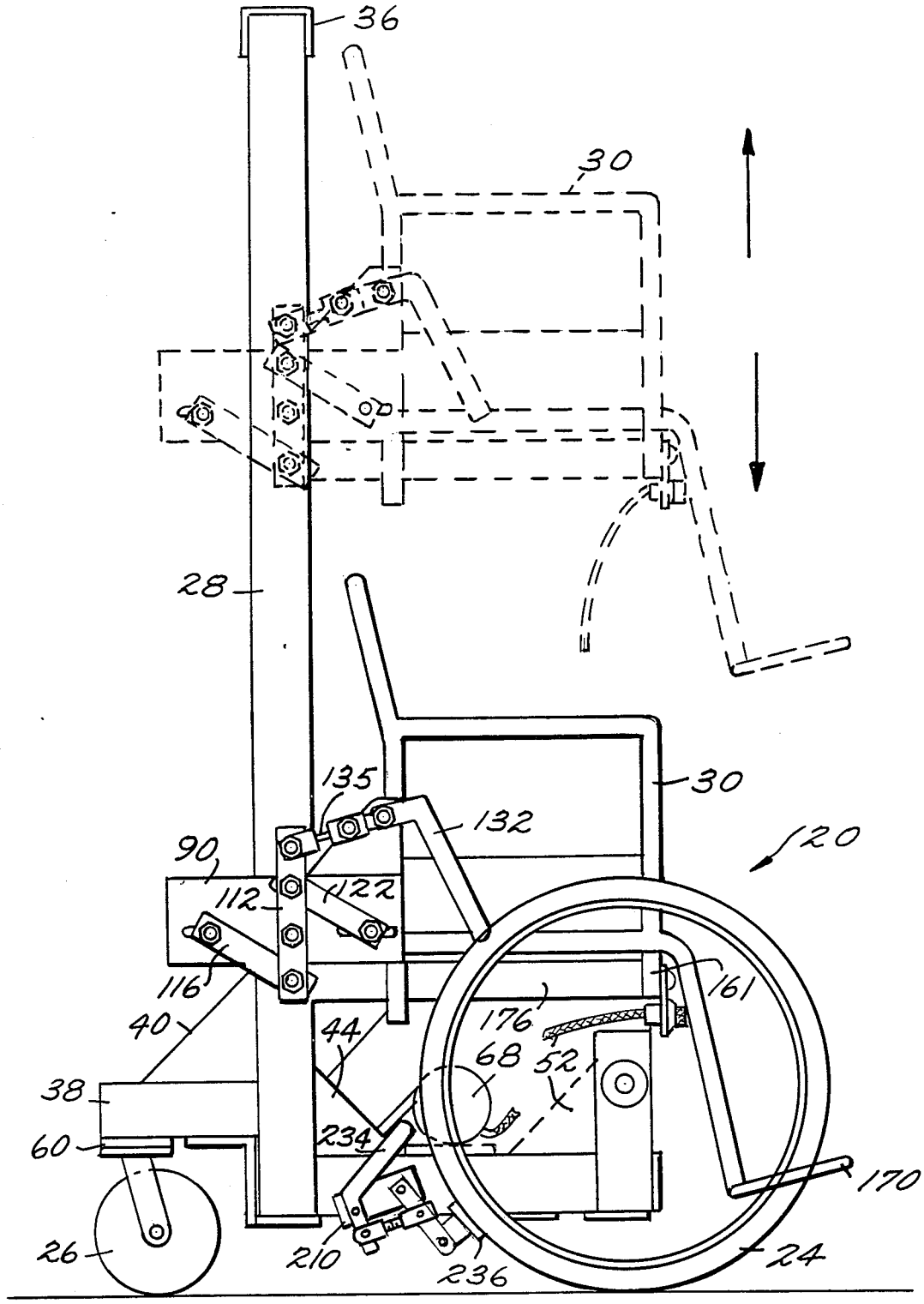
FIG. 1 is a side elevation view of the wheel chair and illustrating the chair in raised and lowered positions.
Figure 4:
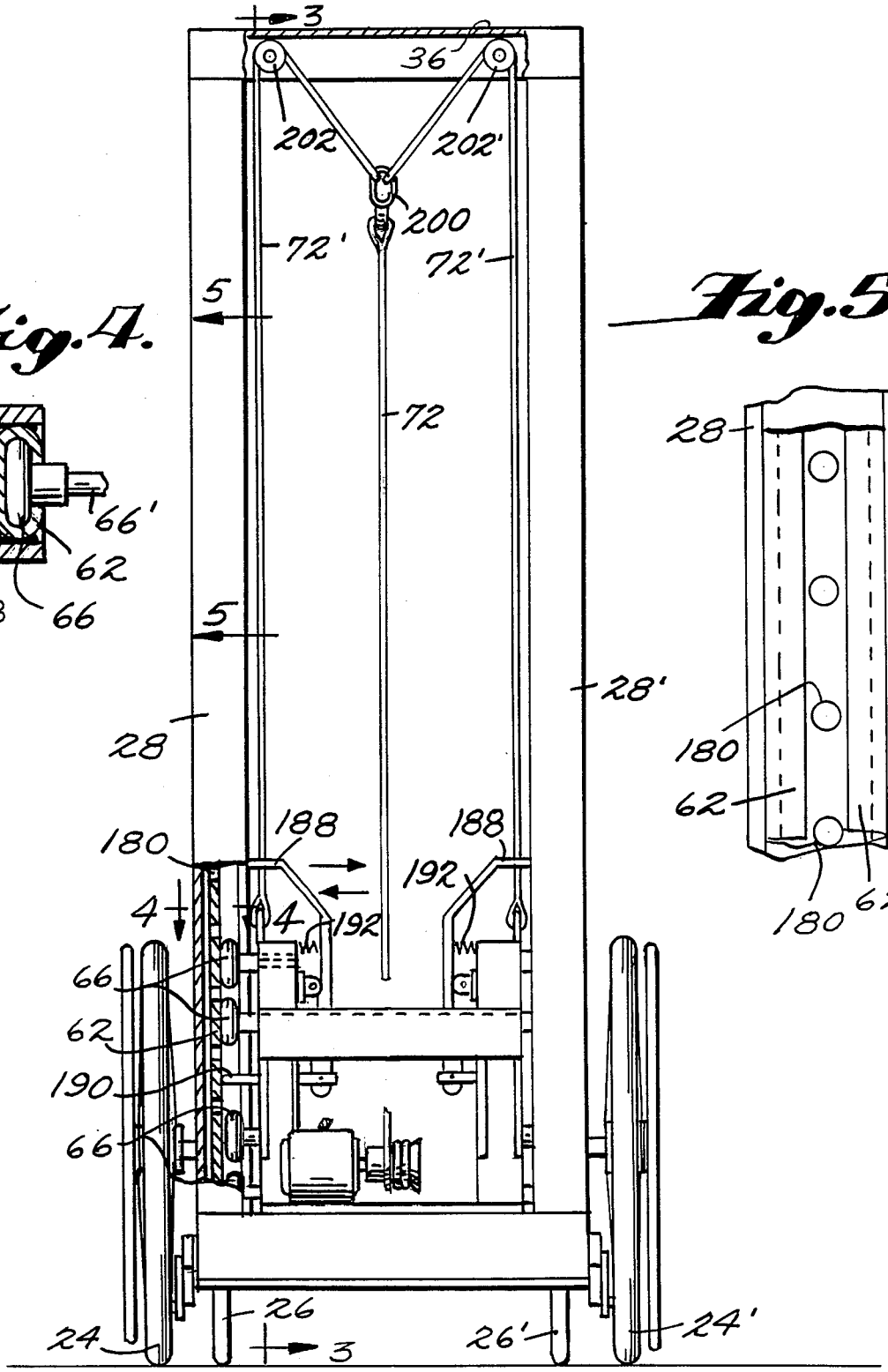
FIG. 4 is a sectional view taken along the line 4—4 in FIG. 2 and looking in the direction of the arrows.
Figure 5:
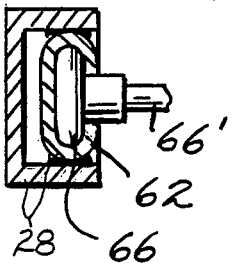
FIG. 5 is a sectional view taken along the line 5—5 in FIG. 2 and looking in the direction of the arrows.

With reference now to the drawings, wherein like reference characters designate like or corresponding parts throughout the several views, there is shown a wheel chair 20 in accordance with this invention. The wheel chair includes a frame assembly 22 (FIG. 11)and a plurality of wheels 24, 24', 26 and 26' attached to and normally supporting frame assembly 22. First pair of driving wheels 24, 24' are positioned for normally enabling the operator to propel the wheel chair by turning wheels 24, 24' when the operator is seated in chair 30, and second pair of following wheels, 26, 26' provide additional support for the wheel chair. A pair of opposed, substantially vertical track members 28, 28' are positioned between first pair of wheels 24, 24' and second pair of wheels 26, 26' for optimum weight distribution, and track members 28, 28' are attached to and project upwardly from frame assembly 22. A chair 30 is provided, and means 32 (FIG. 6) are provided in operative relationship with chair 30 and with track members 28, 28' for selectively moving the chair substantially along the lengths of the track members.

Frame assembly 22 (FIG. 11) includes a horizontal cross member 34 supporting vertical track members 28, 28'. A support member 36 extends between track members 28, 28' at the top of the track members, and side rails 38, 38' project rearwardly from track members 28, 28'. Gusset stiffeners 40, 40' connect rails 38, 38' to respective ones of track members 28, 28'. Side rails 42,

42' project horizontally and in parallel relationship to each other in a forward direction from track members 28, 28', respectively, at the bottom of cross member 34. Gusset stiffeners 44, 44' connect rails 42, 42' to track members 28, 28', respectively, and to cross member 34. Winch mounting plate 46 extends between and is connected to side rails 42, 42', and battery mounting plate 48 similarly extends between and is connected to side rails 42, 42'.

Axle posts 50, 50' extend vertically from the forward ends of rails 42, 42', respectively, and in parallel relationship to one another. The axle posts are attached to side rails 42, 42' by means of gusset stiffeners 52, 52', respectively. Horizontal cross support angle 54 connects axle posts 50, 50' and lower flange 54' of angle 54 is mounted against lower surfaces 56, 56, of posts 50, 50', respectively. Cross support angle 54 is also positioned with its ends in substantial alignment with the outer surfaces of side rails 42, 42'. Preferably, molded rubber-type pads 58, 58' are positioned atop posts 50, 50' respectively. Following wheels 26, 26' are mounted on swivel casters, and wheels 26, 26' are mounted to flanges 60, 60' on the under side of side rails 38, 38', respectively. Driving wheels 24, 24' are rotatably mounted to axle posts 50, 50' respectively, and track elements 62, 62' are mounted within track members 28, 28', respectively, and in opposition to one another.

In accordance with the invention, moving means 32 (FIG. 6) include a support assembly 64 attached to and supporting chair 30, a plurality of roller elements 66 attached to support assembly 64 and in engaging relationship with respective ones of track members 28, 28' for vertical movement along track elements 62, 62', a winch 68 (FIG. 11) mounted on winch mounting plate 46, first and second pulleys 70, 70' (FIG. 12) mounted on support member 36, and lines 72, 72' partially wound on winch 68, extending over pulleys 70, 70' and attached to support assembly 64.

Moving means 32 (FIG. 6) include a battery or other conventional source of D.C. voltage 74 (FIG. 10). A D.C. motor 76 is in operative circuit relationship with battery 74 for operating winch 68, and a spring-loaded, normally open, reversible switch 78 is provided in circuit relationship between battery 74 and motor 76 for enabling an operator to selectively activate winch 68 to raise or lower chair 30.

An alarm 80 is provided in circuit relationship with battery 74, and an alarm switch 82 (FIG. 8) is mounted on one of track members 28, 28' and in circuit relationship between battery 74 and alarm 80 for enabling energization of alarm 80 by battery 74 when a predetermined part of moving means 32 contacts and closes alarm switch 82. The operator is alerted by the sounding of alarm 80 when chair 30 is nearing its upward limit of travel along track members 28, 28'.

As shown in FIG. 8, alarm switch 82 can be a conventional rocker-action switch mounted on a side portion of one of track members 28, 28'. A roller 84 is mounted to the inside surface 91 of a predetermined portion 90 of moving means 32 by spring fastener 86 whereby roller 84 contacts and changes the position of switch 82 as the roller passes over switch 82.

Figure 6:
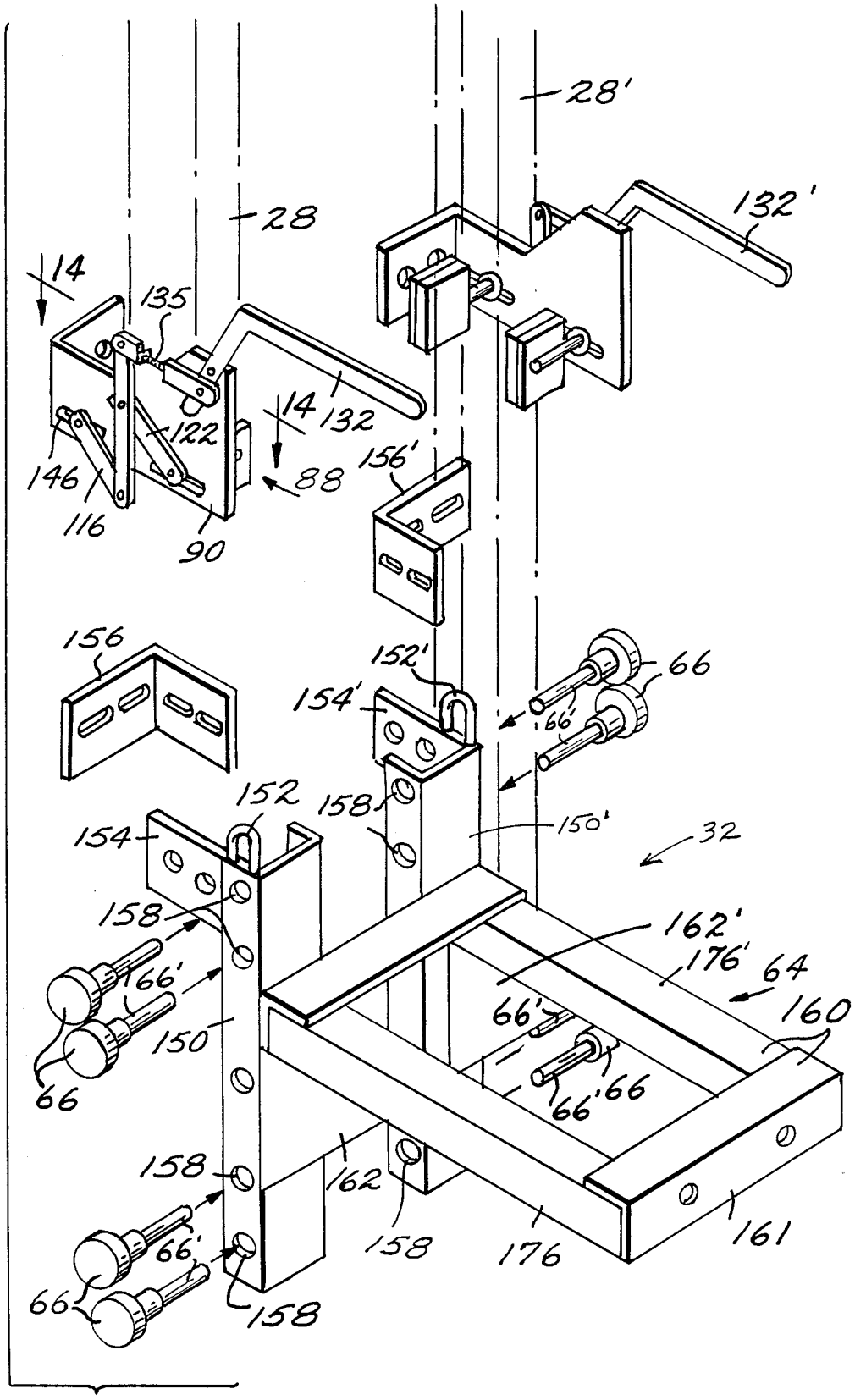
FIG. 6 is an exploded perspective view of a portion of the wheel chair assembly.
Figure 14:
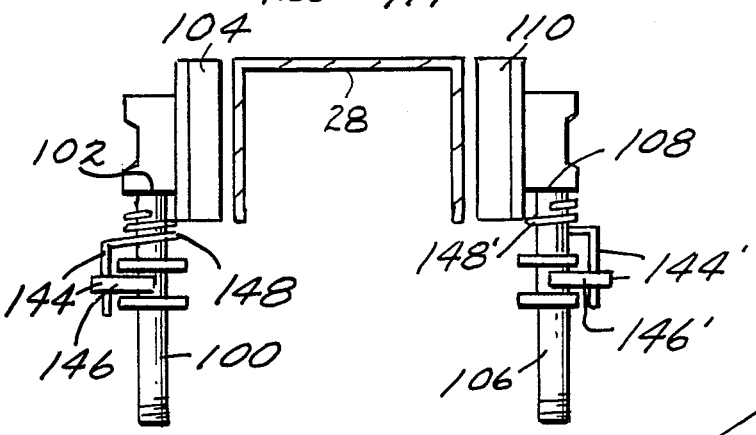
FIG. 14 is a fragmentary cross sectional view taken along the line 14—14 in FIG. 6 and looking in the direction of the arrows.

In accordance with the invention and as best shown in FIGS. 6 and 14, means 88 are provided in operative relationship with moving means 32 and with track members 28, 28' for releasably securing chair 30 in positions with respect to track members 28, 28'. Securing means 88 include a support element 90 attached to support assembly 64, and support element 90 defines first and second elongated openings 92,92' therein in substantial alignment with each other. A first pin 94 is mounted to support element 90 substantially equidistant between opening 92 and 92', and pin 94 projects outwardly from a first surface 96 of support element 90. A second pin 98 is mounted to support element 90 in a predetermined position thereon and projects outwardly from surface 96, and a third pin 100 projects through and is slideable substantially along the length of first elongated opening 92. Pin 100 is positioned with a first end 102 thereof adjacent to track member 28. A first resilient friction pad 104 is attached to end 102 of pin 100 for selectively frictionally engaging first track member 28.

Securing means 88 further include a fourth pin 106 projecting through and slideable substantially along the length of second elongated opening 92', and pin 106 is positioned with a first end 108 thereof adjacent to first track member 28. A second resilient friction pad 110 is attached to first end 108 of pin 106 for selectively frictionally engaging first track member 28.

A first link element 112 is rotatably mounted on first pin 94 and adjacent to surface 96 of support element 90. Link element 112 defines first and second opposed ends 114, 114'. A second link element 116 is rotatably mounted on third pin 100 at a first end 118 of link element 116, and a second end 118' of link element 116 is rotatably connected to end 114 of link element 112 by means of pin 120.

Securing means 88 further include a third link element 122 having a first end 124 rotatably mounted on fourth pin 106 and a second end 124' rotatably connected to first link element 112 by pin 126 substantially equidistant between first pin 94 and end 114' of first link element 112. A fourth link element 128 is rotatably mounted on second pin 98 adjacent to surface 96, and link element 128 defines a first end 130 and a second opposed tapered end 130'. A lever member 132 is attached to end 130 of link element 128, and a fifth adjustable-length 136'. End 136 of link element 134 is rotatably attached to second end 114' of first link element 112, and second end 136, of fifth link element 134 is attached to fourth link element 128 at a predetermined distance from tapered end 130' thereof. A stop element 138 is attached to fifth link element 134, and stop element 138 is positioned to engage tapered end 130' of fourth link element 128 when lever member 132 is pushed downwardly to a predetermined position.

A seventh pin 140 rotatably connects together first link element 112 with fifth link element 134, and an eighth pin 142 rotatably connects together fourth link element 128 with fifth link element 134. Second link element 116 is substantially equal in length to third link element 122. Tapered end 130' of fourth link element 128 contacts stop element 138 when lever member 132 is pushed downwardly to a predetermined position and when eighth pin 142 is moved into and slightly past alignment with second pin 98 and seventh pin 140 whereby maximum clamping action by friction pads 104, 110 against first track member 28 occurs and whereby the friction pads are locked into position against track member 28.

In accordance with the invention, first means 144 are provided in operative relationship with third pin 100 and with first opening 92 for restraining rotational movement of pin 100 about its own axis. Likewise, second means 144' are provided in operative relationship with fourth pin 106 and with second opening 92' for restraining rotational movement of pin 106 about its own axis. First movement restraining means 144 preferably include a first retainer element 146 positioned within first opening 92 and a first spring member 148 connected between retainer element 146 and third pin 100. Second movement restraining means 144' include a second retainer element 146' positioned within second opening 92' and a second spring member 148' connected between retainer element 146' and fourth pin 106.

In accordance with the invention, support assembly 64 (FIG. 6) includes lift rails 150, 150' of equal size, and each has a loop 152, 152', respectively, at the top for attaching lines 72, 72' at the top outer surface of each rail 150, 150'. Flanges 154, 154' project rearwardly from lift rails 150, 150', respectively, and post lock angles 156, 156' are attached to flanges 154, 154'. Holes 158 are provided through the sides of each lift rail 150, 150' to receive shafts 66' of roller elements 66. Lift rails 150, 150' are connected to a rigid platform 160 by means of gusset stiffeners 162, 162'. Roller elements 66 fit into tracks 62, 62' attached to track members 28, 28', respectively, to allow support assembly 64 to move vertically between track members 28, 28'. Lower flange 166 of cross member 34 provides a stop for support assembly 64 at the lower limit of travel.

Figures 3, 9:
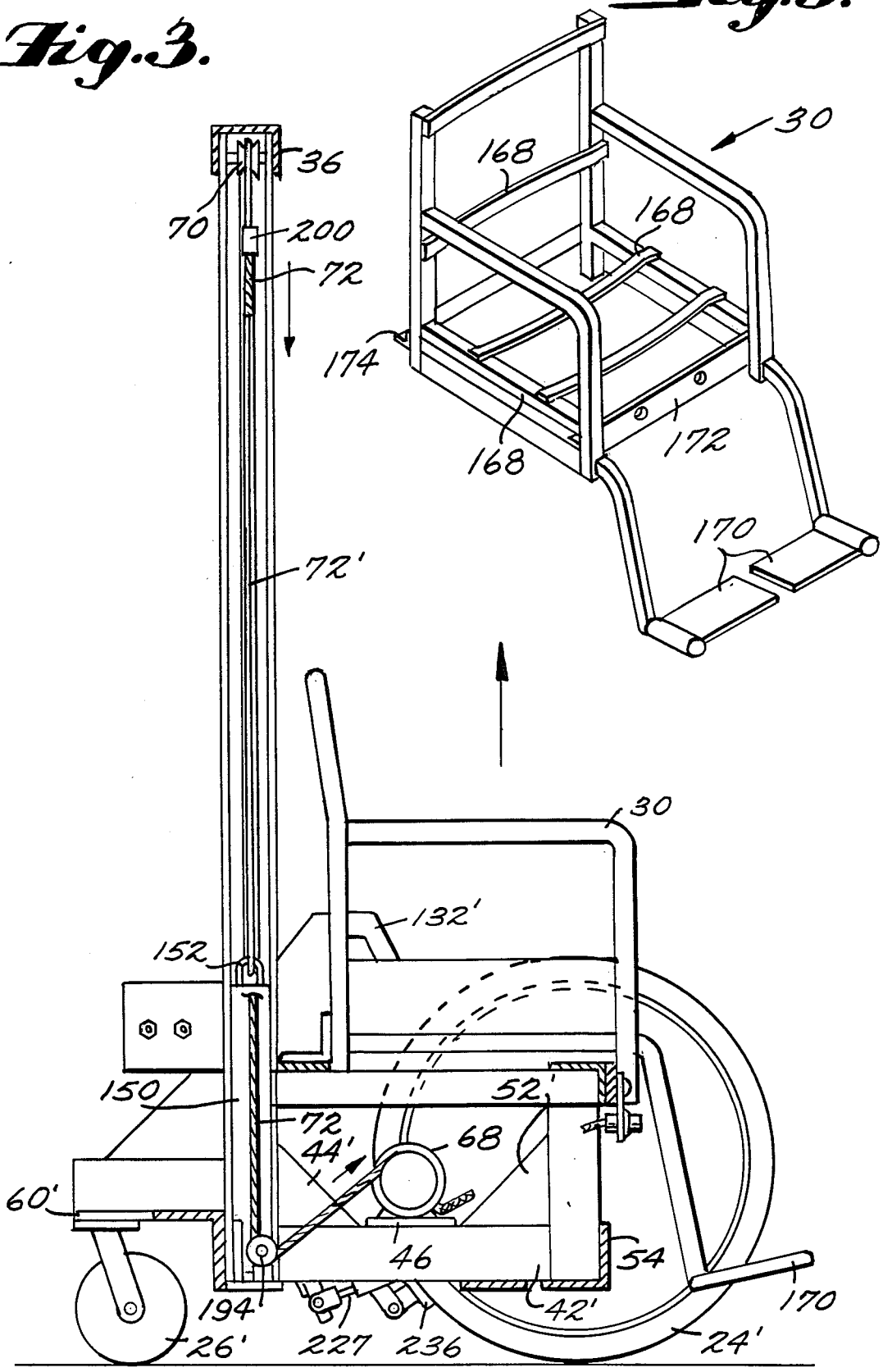
FIG. 3 is a cross sectional view of the invention along the line 3—3 in FIG. 2 and looking in the direction of the arrows.
FIG. 9 is a perspective view of the chair portion of the wheel chair assembly.

Chair 30 (FIG. 9) includes a rigid frame 168, and chair 30 is mounted to platform 160. The chair is preferably of tubular and strap construction, and the seat and back are adapted to receive padding and upholstery by conventional means. Foot rests 170 pivot upwardly in a conventional manner to provide easy chair access. Cross brace 172 located under the front of the seat portion of chair 30 is attached to front cross member 161 of platform 160, and angle cross member 174 of chair 30 is attached to side rails 176, 176' of platform 160. Chair frame 168 rests on pads 58, 58' at the lower limit of travel of chair 30.

Figure 2:
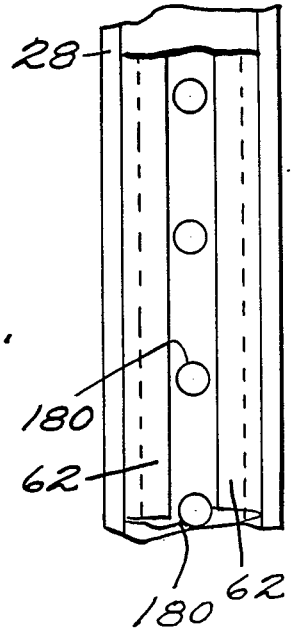
FIG. 2 is a fragmentary front elevation view of the invention with the chair and other portions removed for the purpose of illustration.

As illustrated in FIGS. 2 and 7, wheel chair 20 includes means 178 in operative relationship with moving means 32 and with at least one of track members 28, 28' for preventing chair 30 from falling in an uncontrolled manner. Track members 28 or 28', with which fall preventing means 178 is associated, defines a plurality of aligned holes 180 along a predetermined portion of its length, and preventing means 178 preferably include a spring-biased pin means 182 in operative relationship with moving means 32 for enabling insertion of a predetermined portion of pin means 182 into one of holes 180 upon failure of moving means 32 to properly support chair 30. More specifically, fall preventing means 178 include a mounting element 184 attached at a predetermined location to support assembly 64. A rod element 186 is pivotally mounted to mounting element 184 and defines a first hook end 188 encircling line 72'. Element 186 further defines a second end 188', and a pin member 190 is attached to end 188' and in alignment with the line of holes 180 in track element 62. A spring 192 is positioned between support assembly 64 and rod element 186 whereby loss of tension on line 72' causes spring 192 to rotate rod element 186 and pin member 190 to enable pin member 190 to enter one of holes 180 to stop descending movement of chair 30. Releasably securing means or post locks 88 (FIG. 6 and 13) should then be set to hold chair 30 in position, and pin 190 then can be manually retracted from hole 180. A gradual release of securing means or post locks 88 will then provide a controlled descent of chair 30.

Figure 11:
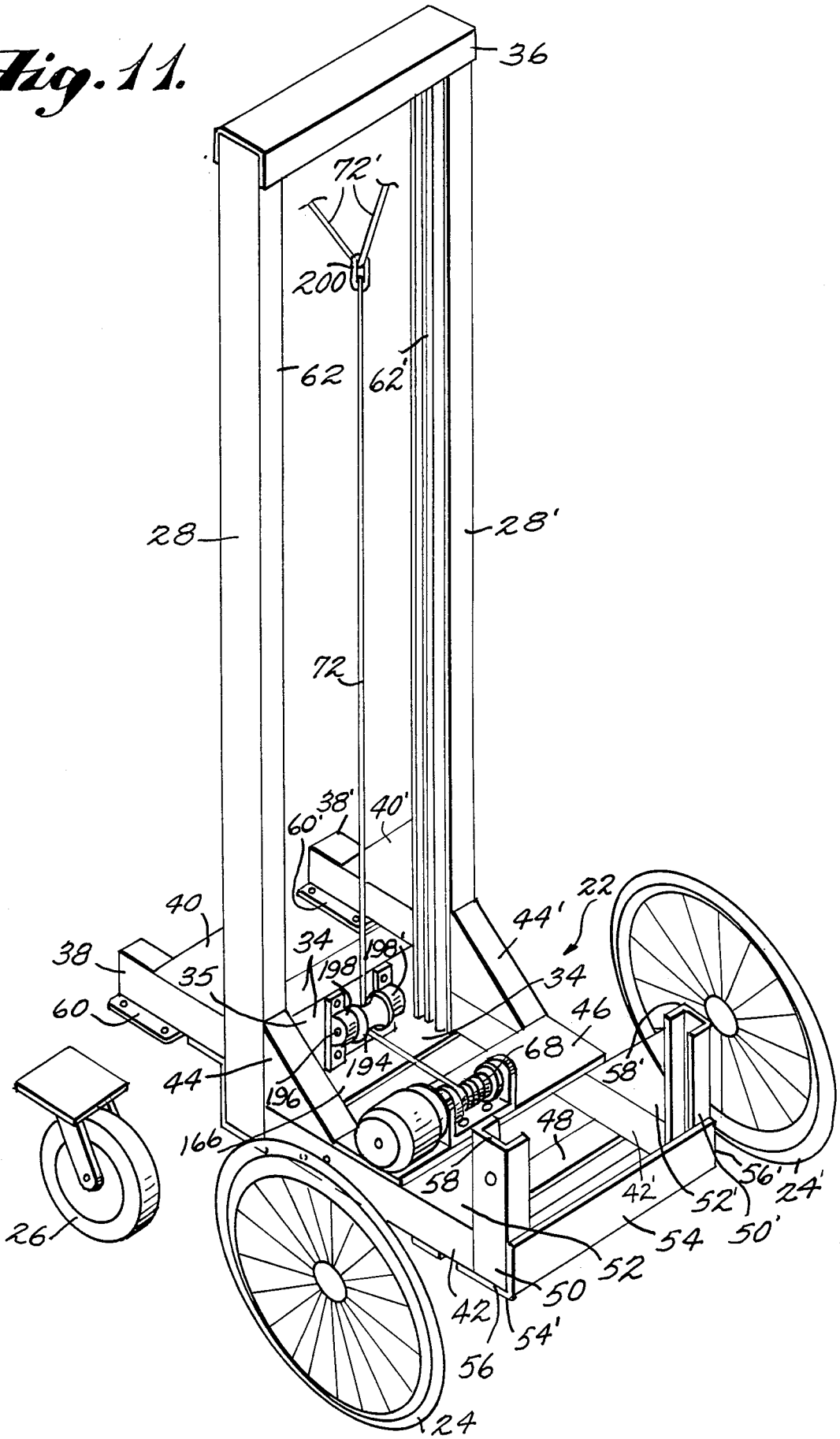
FIG. 11 is a partially exploded perspective view of the wheel chair with portions omitted for the purpose of illustration.
Figure 12:
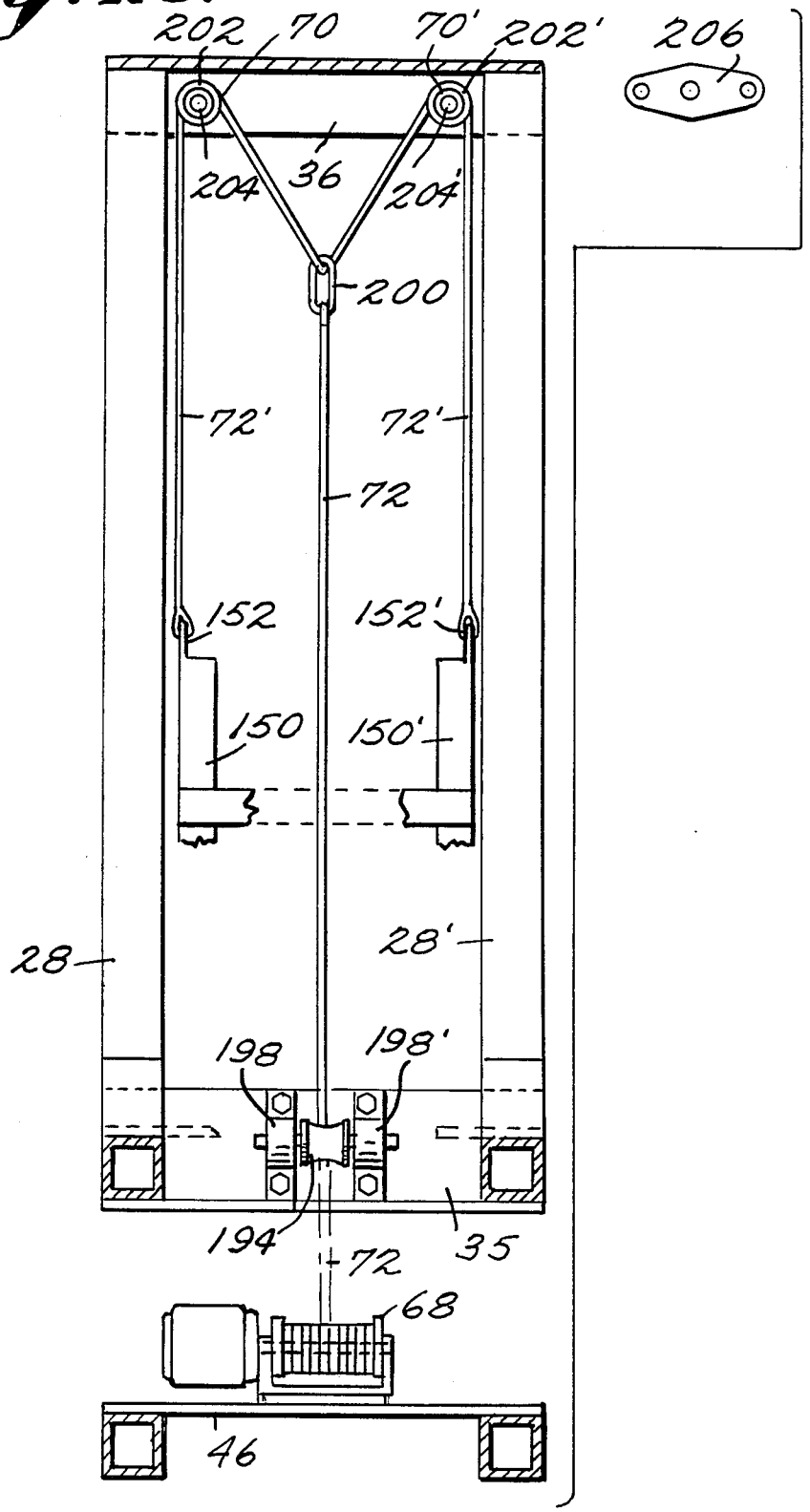
FIG. 12 is a fragmentary front elevation view, partly in section, of the wheel chair with portions omitted for the purpose of illustration.

FIGS. 2, 3, 11 and 12 illustrate the winch-cable-pulley system used to raise and lower chair 30. Winch 68 is preferably a low voltage D.C. electric winch which is powered by an automotive type storage battery 74, and winch 68 preferably has a stop-lock feature. Winch 68 is mounted on mounting plate 46, and a single line 72 is drawn behind guide pulley 194 mounted on shaft 196 (FIG. 11). Shaft 196, in turn, is supported by a pair of standard mount bearing blocks 198, 198', which are mounted to vertical surface 35 of horizontal cross member 34. Guide pulley 194 is centered between track members 28, 28' and line 72 extends upwardly from pulley 194 to connector link 200. Link 200 is located below support member 36 when chair 30 is at its lowermost position, and lines 72' are attached to connector link 200. Lines 72' extend over lift pulleys 202, 202', respectively (FIG. 12), and lines 72' extend downwardly from pulleys 202, 202' to loops 152, 152' on lift rails 150, 150'. Lift pulleys 202, 202' are located directly above loops 152, 152', respectively. Pulleys 202, 202' are secured to shafts 204, 204', respectively, which pass through holes in front and rear flanges of support member 36. Bearing blocks 206 support shafts 204, 204', and one block 206 is shown in FIG. 12 in an exploded view for the purpose of illustration.

Figure 15:
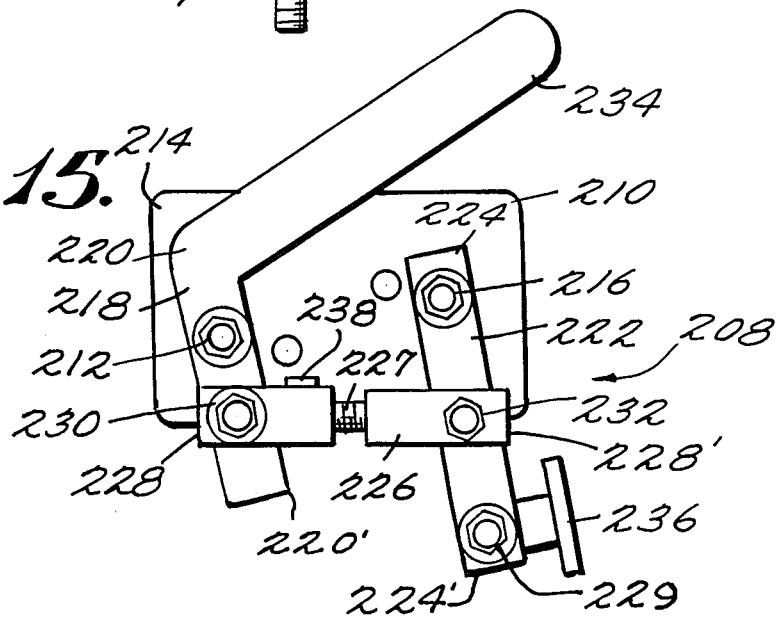
FIG. 15 is a side elevation view of the braking means in accordance with the invention.

As shown in FIGS. 1 and 15, wheel chair 20 further includes means 208 attached to frame assembly 22 and in operative relationship with wheels 24, 24' for selectively contacting and braking movement of the wheels. In accordance with the invention, braking means 208 include a support member 210 attached to frame assembly 22, a first pin element 212 mounted on support member 210 and projecting outwardly from outer surface 214 of support member 210, a second pin element 216 mounted to support member 210 and projecting outwardly from outer surface 214, and a first link member 218 rotatably mounted on pin element 212 and adjacent to outer surface 214. Link member 218 defines a first end 220 and a second opposed tapered end 220'. A second link member 222 defines a first end 224 rotatably mounted on second pin element 216 adjacent to outer surface 214, and link member 222 defines a second opposed end 224'. Braking means 208 further include a third adjustable length link member 226 which defines first and second opposed ends 228, 228'. First end 228 is rotatably attached adjacent to second end 220' of first link member 218 by means of third pin element 230, and second end 228' is rotatably attached to second link member 222 by fourth pin element 232. A lever element 234 is attached to first end 220 of link member 218, and a brake pad 236 is attached to second end 224' of link 222. A stop member 238 is attached to third link member 226 and is positioned to engage tapered end 220' of link member 218 when lever element 234 is raised upwardly to a predetermined position and when third pin element 230 is moved into and slightly past alignment with first pin element 212 and with fourth pin element 232.

FIG. 10 illustrates the circuitry associated with wheel chair 20. Switch 240 is an overload circuit breaker connected between battery 74 and main control reversible switch 78. Switch 78 is spring loaded for automatic shut-off, and the position of switch 78 controls the direction of movement of motor 76 and winch 68 so that chair 30 can be selectively raised and lowered along the length of track members 28, 28'. Switch 82 is located on one of track members 28 or 28', as previously described.

Switch 78 can be mounted at any convenient location for access by the operator.

In operation, movement by the operator of switch 78 to a forward position causes winch 68 to turn in a predetermined direction so that line 72 is wound on the winch. This, in turn, causes lines 72' to raise lift rails 150, 150'. As a result, support assembly 64 and chair 30 are also raised, and chair 30 will continue to rise as long as switch 78 is maintained in the "raise" position. If chair 30 approaches its upward limit of travel, roller 84 will contact alarm switch 82 and alarm 80 will sound to alert the operator.

When chair 30 has reached a height along the length of track members 28, 28' desired by the operator, switch 78 will be released by the operator and switch 78 will automatically move to a position to shut off winch motor 76. Locking of chair 30 into position can then be quickly and easily accomplished by means of releasable securing means or post locks 88. A separate post lock mechanism 88 is positioned adjacent to each of track members 28, 28', and chair 30 is locked into position with respect to the track members by the operator rotating lever members 132, 132' of each lock mechanism 88 in a downward direction until friction pads, 104, 110 tightly engage the track members. Post locking assemblies 88 also provide a means of controlled descent of chair 30 should tension on lines 72, 72'be released.

Figure 13:
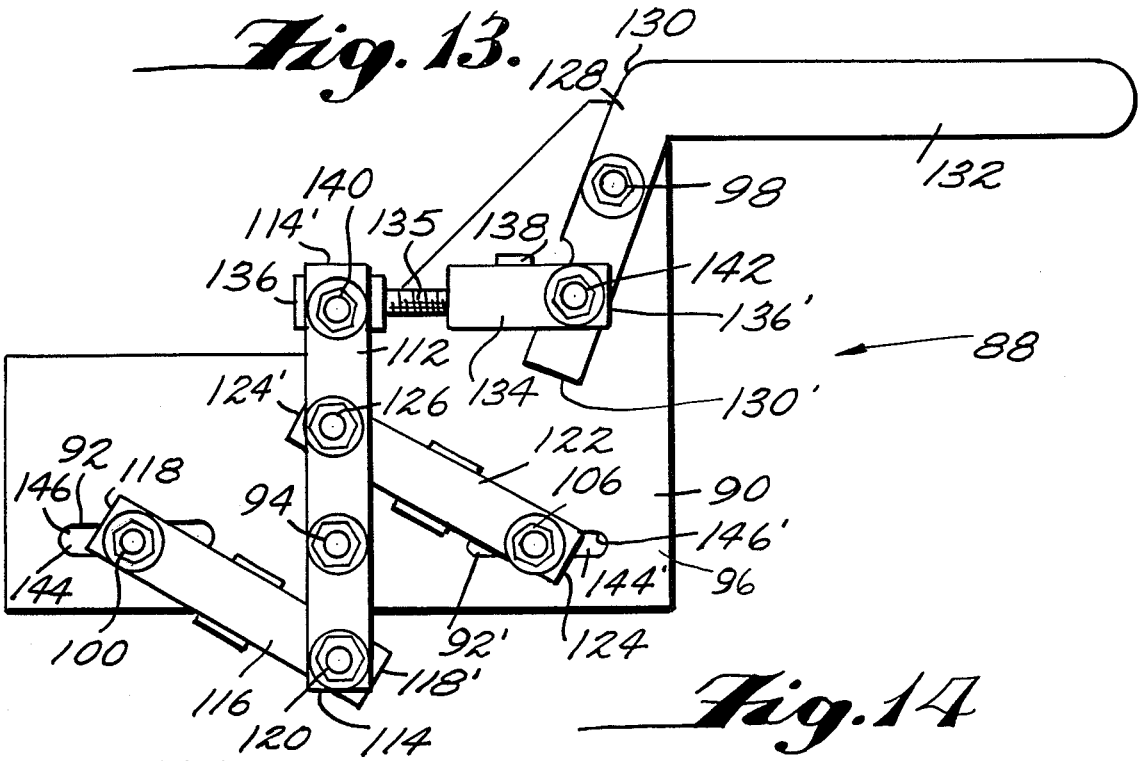
FIG. 13 is a side elevation view of a releasably securing means in accordance with the invention.

Each of post lock assemblies 88 is a double-action, quick-release clamping device with an internal adjustment feature. When each lever member 132 is pushed downwardly by the operator, each link element 128 rotates in a clockwise direction about pin 98 (FIG. 13). Link element 134 moves to the left causing link 112 to rotate about fixed pin 94 in a counter-clockwise direction. This counter-clockwise rotation of link element 112 causes translation link elements 116, 122 to follow openings 92, 92', respectively, inwardly to provide a clamping action by pins 100, 106 and by friction pads 104, 110 upon the track members. Preferably, friction pads 104, 110 are attached to metal backing plates 104', 110', respectively, and backing plates 104', 110' are attached to the ends of pins 100, 106, respectively.

Maximum clamping action occurs when lever member 132 is pushed down to a position where pin 142 travels slightly beyond linear alignment with pins 98 and 140. Second end 130' of link element 128 is slightly tapered to permit travel of pin 142 slightly beyond linear alignment with pins 98 and 140 before contact is made by the tapered portion of end 130' with stop member 138 at the top of link element 134. The resultant moment imparted by link element 134 is clockwise thereby creating a locked condition of the mechanism.

Link element 134 is of two-part construction having a threaded connector 135 to permit lengthening or shortening of link element 134. This adjustment permits compensation for a variation in thickness of pads 104, 110 due to wear and provides a fine adjustment of post lock mechanisms 88.

When the operator desires to lower the position of chair 30, lever members 132 of each post lock assembly 88 are raised to remove friction pads 104, 110 from engagement with track members 28, 28' Main control switch 78 is then moved by the operator to a "lower" position to activate winch motor 76 and winch 68. Line 72 is then payed out from the winch, and lines 72' lower lift rails 150, 150' and support assembly 64 until chair 30 is in the desired position. The operator then releases main control switch 78 which automatically de-activates motor 76 and winch 68 to stop movement of the chair. Post lock assemblies 88 can then be locked into position against track members 28, 28' to safely hold chair 30 in the desired position.

It will be desirable to maintain stability of the chair on non-level terrain. This can be accomplished by incorporating conventional levelers at the four lower corners of frame assembly 22. It may also be beneficial to install a power drive system, and this can be accomplished by adding a conventional twenty-four volt friction drive system.

The lowered seat height of wheel chair 20 is equal to the height of a standard model Everest and Jennings collapsible wheel chair. The width of wheel chair 20 is also equal to a standard model Everest and Jennings collapsible wheel chair while the overall length of chair 20 is three and one-half inches greater and the wheel base is increased by ten and one-half inches. The stability of chair 20 is substantially increased because of a low center of gravity, a rigid frame and the extended wheel base. Track members 28, 28' typically extend to a height of approximately seventy seven inches, allowing passage through standard eighty inch residential door openings. The maximum lift provided is forty six and one-half inches, providing the occupant with an equivalent height of approximately eight feet.

Braking of chair 20 is accomplished by braking means 208, shown in FIG. 15. A separate braking means 208 is provided adjacent to each wheel 24, 24'. Pulling lever element 234 upwardly and in a backward direction with respect to chair 20 causes brake member 218 to rotate in a counter-clockwise direction about fixed pin element 212. Adjustable link member 226 then moves to the right causing link member 222 to rotate in a counter-clockwise direction about fixed pin element 216. Brake pad 236 then moves forwardly and into contact with the tire of a wheel 24 or 24'. Maximum braking occurs when pin element 230 is moved into and slightly beyond alignment with pin elements 212 and 232. This occurs when the tapered portion of end 220' of link member 218 makes contact with stop member 238.

Link member 226 is of two part construction with a threaded connector 227 to allow adjustment of the travel of brake pad 236. Brake pad 236 is secured to link member 222 by means of locking nut and bolt 229. Any adjustment of link member 226 will require readjustment of the position of brake pad 236 so that the braking force imparted to the wheel will be directed radially with respect to the wheel.

This invention provides for a new and improved wheel chair with an elevating seat having a high lift capability which enables the operator to perform household and other tasks which otherwise would not be possible.

The invention in its broader aspects is not limited to the specific details shown and described and departures may be made from such details without departing from the principals of the invention and without sacrificing its chief advantages.

I claim:

1. A wheel chair, comprising:

a frame assembly;

a plurality of wheels attached to and normally supporting said frame assembly;

a pair of opposed, substantially vertical track members attached to and projecting upwardly from said frame assembly;

a chair;

means in operative relationship with said chair and said track members for selectively moving said chair substantially along the lengths of said track members; and securing means mounted on said moving means and in operative relationship with said track members and with said chair for releasably clamping onto said track members to secure said chair in position with respect to said track members.

2. A wheel chair as in claim 1 further including a support member extending between said track members and wherein said moving means include:

a support assembly attached to and supporting said chair;

a plurality of roller elements attached to said support assembly and in engaging relationship with respective ones of said track members for vertical movement along said track members;

a winch mounted on said frame assembly;

first and second pulleys mounted on said support member; and a line partially wound on said winch, extending over said pulleys and attached to said support assembly.

3. A wheel chair as in claim 2 wherein said moving means further include:

a source of d.c. voltage;

a d.c. motor in operative relationship for operating said winch; and a spring-loaded, normally open reversible switch in circuit relationship between said voltage source and said motor for enabling an operator to selectively activate said winch to raise or lower said chair.

4. A wheel chair as in claim 3 further including:

an alarm in circuit relationship with said voltage source; and an alarm switch mounted on one of said track members and in circuit relationship between said voltage source and said alarm for enabling energization of said alarm by said source when a predetermined part of said moving means contacts and closes said alarm switch, whereby the operator is alerted when said chair is nearing its upward limit of travel.

5. A wheel chair as in claims 2 or 4 wherein said securing means include:

a support element attached to said support assembly, said support element defining first and second elongated openings therein in substantial alignment with each other;

a first pin mounted to said support element substantially equidistant between said openings and projecting outwardly from a first surface of said support element;

a second pin mounted to said support element in a predetermined position thereon and projecting outwardly from said first surface;

a third pin projecting through and slideable along the length of said first elongated opening, and positioned with a first end thereof adjacent to a first one of said track members;

a first resilient friction pad attached to said first end of said third pin for selectively frictionally engaging said track member;

a fourth pin projecting through and slideable along the length of said second elongated opening, and positioned with a first end thereof adjacent to said first track member;

a second resilient friction pad attached to said first end of said fourth pin for selectively frictionally engaging said first track member;

a first link element rotatably mounted on said first pin and adjacent to said first surface, said first link element defining first and second opposed ends;

a second link element having a first end rotatably mounted on said third pin and a second end rotatably connected to said first end of said first link element;

a third link element having a first end rotatably mounted on said fourth pin and a second end rotatably connected to said first link element substantially equidistant between said first pin and said second end of said first link element;

a fourth link element rotatably mounted on said second pin and adjacent to said first surface, said fourth link element defining a first end and a second opposed tapered end;

a lever member attached to said first end of said fourth link element;

a fifth adjustable length link element defining first and second opposed ends, said first end of said fifth link element rotatably attached to said second end of said first link element and said second end of said fifth link element attached to said fourth link element at a predetermined distance from said second end of said fourth link element; and a stop element attached to said fifth link element and positioned to engage said tapered end of said fourth link element when said lever means is pushed downwardly to a predetermined position.

6. A wheel chair as in claim 5 further including:

a fifth pin rotatably connecting together said first link element and said second link element;

a sixth pin rotatably connecting together said first link element and said third link element, said first pin located substantially equidistant between said fifth pin and said sixth pin;

a seventh pin rotatably connecting together said first link element with said fifth link element; and an eighth pin rotatably connecting together said fourth link element with said fifth link element.

7. A wheel chair as in claim 6 wherein said second link element is substantially equal in length to said third link element.

8. A wheel chair as in claim 7 wherein said tapered end of said fourth link element contacts said stop element when said lever member is pushed downwardly to a predetermined position and when said eighth pin is moved into and slightly past alignment with said second pin and said seventh pin, whereby maximum clamping action by said friction pads against said first track member occurs and whereby said friction pads are locked into position against said first track member.

9. A wheel chair as in claim 8 further including:

first means in operative relationship with said third pin and with said first opening for restraining rotational movement of said third pin about its own axis; and second means in operative relationship with said fourth pin and with said second opening for restraining rotational movement of said fourth pin about its own axis.

10. A wheel chair as in claim 9 wherein said first movement restraining means include:

a first retainer element positioned within said first opening; and a first spring member connected between said first retainer element and said third pin.

11. A wheel chair as in claim 10 wherein said second movement restraining means include:

a second retainer element positioned within said second opening; and a second spring member connected between said second retainer element and said fourth pin.

12. A wheel chair as in claim 11 further including:

means in operative relationship with said moving means and with at least one of said track members for preventing said chair from falling in an uncontrolled manner.

13. A wheel chair as in claim 12 wherein at least one of said track members defines a plurality of holes along its length and wherein said preventing means include:

spring-biased pin means in operative relationship with said moving means for enabling insertion of a predetermined portion of said pin means into one of said holes upon failure of said moving means to properly support said chair.

14. A wheel chair as in claim 1 further including:

means in operative relationship with said moving means and with at least one of said track members for preventing said chair from falling in an uncontrolled manner.

15. A wheel chair as in claim 14 wherein at least one of said track members defines a plurality of holes along its length and wherein said preventing means include:

spring-biased pin means in operative relationship with said moving means for enabling insertion of a predetermined portion of said pin means into one of said holes upon failure of said moving means to properly support said chair.

16. A wheel chair as in claim 14 wherein at least one of said track members defines a plurality of holes along its length and wherein said preventing means include:

a mounting element attached at a predetermined location to said support assembly;

a rod element pivotally mounted to said mounting element and defining a first hooked end encircling said line . and defining a second end;

a pin member attached to said second end of said rod element and in alignment with said holes; and a spring positioned between said support assembly and said rod element, whereby loss of tension on said line causes said spring to rotate said rod element and said pin member to enable said pin member to enter one of said holes to stop descending movement of said chair.

17. A wheel chair as in claim 1 further including means attached to said frame assembly and in operative relationship with said wheels for selectively contacting and braking movement of said wheels, said braking means including:

a support member attached to said frame assembly;

a first pin element mounted to said support member and projecting outwardly from an outer surface of said support member;

a second pin element mounted to said support member and projecting outwardly from said outer surface;

a first link member rotatably mounted on said first pin element and adjacent to said outer surface, said first link member defining a first end and a second opposed tapered end;

a second link member defining a first end rotatably mounted on said second pin element adjacent to said outer surface and defining a second opposed end;

a third adjustable length link member defining first and second opposed ends, said first end of said third link member rotatably attached adjacent to said second end of said first link member, and said second end of said third link member rotatably attached to said second link member;

a lever element attached to said first end of said first link member;

a brake pad attached to said second end of said second link member; and a stop member attached to said third link member and positioned to engage said tapered end of said first link member when said lever element is raised upwardly to a predetermined position.

18. A wheel chair as in claim 17 further including:

a third pin element connecting together said first link member and said third link member;

a fourth pin element connecting together said second link member and said third link member;

said tapered end of said first link member contacting said stop member when said lever element is raised upwardly to a predetermined position and when said third pin element is moved into and slightly past alignment with said first pin element and said fourth pin element.

* * * * *